US005836685A

United States Patent [19]

Lambert, Sr.

[11] Patent Number: 5,836,685

[45] **Date of Patent: *Nov. 17, 1998**

[54] METHOD FOR CONTINUOUSLY TREATING PARTICULATE MATERIAL IN A SLURRY IN A HIGH TEMPERATURE AND HIGH PRESSURE CHAMBER EMPLOYING INTERMITTENT FEED

[76] Inventor: Raymond E. Lambert, Sr., P.O. Box 334, Cataumet, Mass. 02534-0334

[ * ] Notice: The term of this patent shall not extend beyond the expiration date of Pat. No. 5,628,561.

[21] Appl. No.: 801,507

[22] Filed: Feb. 4, 1997

Related U.S. Application Data

[63] Continuation of Ser. No. 627,689, Apr. 2, 1996, Pat. No. 5,628,561.

[51] Int. Cl.[6] ..... B01F 15/02

[52] U.S. Cl. ..... 366/136; 366/159.1

[58] Field of Search ..... 366/2, 7, 22, 136, 366/137, 144, 147, 148, 150.1, 159.1, 177.1, 279, 325.1, 325.92

[56] References Cited

U.S. PATENT DOCUMENTS

| | | | |
|---|---|---|---|
| 3,830,473 | 8/1974 | Lieferman et al. | 366/136 |
| 4,464,484 | 8/1984 | Yoshimura et al. . | |
| 5,122,545 | 6/1992 | Kuwabara et al. . | |
| 5,130,341 | 7/1992 | Kuwabara et al. . | |
| 5,340,210 | 8/1994 | Patel et al. | 366/132 |
| 5,340,841 | 8/1994 | Tokoro et al. . | |
| 5,391,581 | 2/1995 | Kuwabara et al. . | |
| 5,407,299 | 4/1995 | Sutton | 366/2 X |
| 5,522,660 | 6/1996 | O'Dougherty et al. | 366/136 |

*Primary Examiner*—Charles E. Cooley
*Attorney, Agent, or Firm*—John A. Haug

[57] ABSTRACT

A continuous particle treating system (10) is shown having an elongated treatment chamber (12) with a slurry supply network (14) connected to the inlet end (12a) of the chamber and an outlet network (16) connected to the outlet end (12b) of the chamber. The supply network includes a loading char (24) coupled to a slurry container (18) forming a main circulation loop and a by-pass conduit (32) connected in parallel with the loading chamber forming a by-pass loop with the slurry container. High pressure liquid (36) is used to pressurize the treatment (12) and at selected times during an operational cycle, the loading chamber (24). A plurality of valves (V1–V7) are interconnected and sequenced to maintain slurry circulation at all times and to intermittently separate the loading chamber (24) from the circulation path and to pass on the slurry in the loading chamber into the treatment chamber (12). She outlet network (16) includes an unloading chamber (40) and a plurality of valves (V8–V10) to remove treated material from treatment chamber (12) and, if desired, to further treat such material at high pressure and/or high temperature before releasing the material to a collection site at atmospheric pressure. The treatment chamber is heated (46) and stirred (48). A programmable controller (44) is used to energize the valves in a selected sequence.

1 Claim, 1 Drawing Sheet

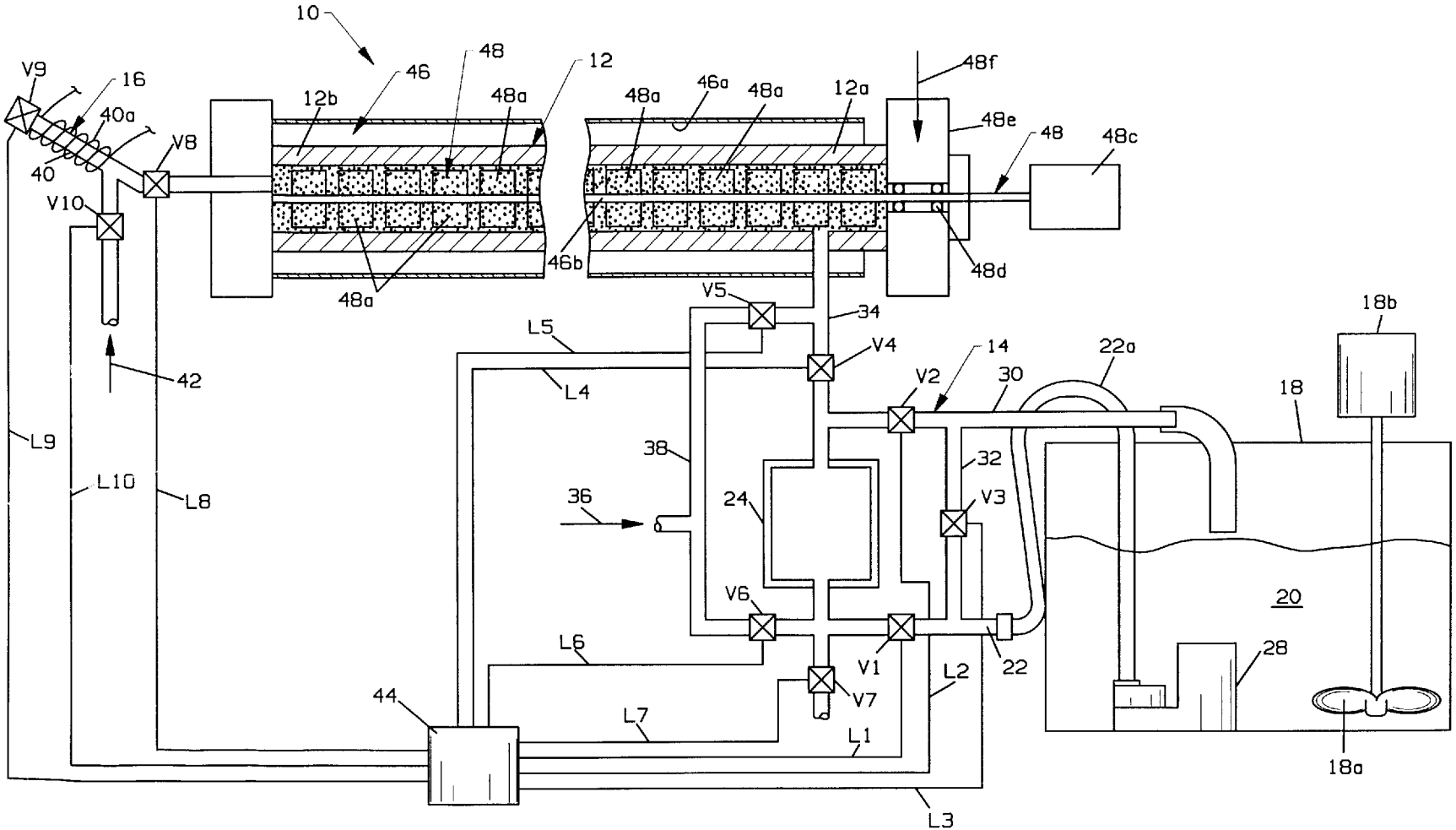
18b
18a
18
20
28
22a
22
48c
48
48e
48d
48f
30
14
32
V3
L2
L3
V2
V1
V7
L1
12a
34
V4
48a
46a
V5
24
V6
38
36
L7
L6
L5
L4
12
46b
48a
48
46
10
12b
44
V8
42
L8
16
40a
40
V10
L10
V9
L9

METHOD FOR CONTINUOUSLY TREATING PARTICULATE MATERIAL IN A SLURRY IN A HIGH TEMPERATURE AND HIGH PRESSURE CHAMBER EMPLOYING INTERMITTENT FEED

RELATED APPLICATIONS

This application is a continuing application of Ser. No. 08/627,689, filed Apr. 2, 1996 now U.S. Pat. No. 5,628,561.

FIELD OF THE INVENTION

This invention relates generally to continuous treatment of particulate material at high pressure and high temperature conditions and more particularly to an apparatus and method in which particulate material in a slurry is fed into a chamber maintained at selected high pressure and/or elevated temperature conditions and treated for a selected period of time and then discharged for collection.

BACKGROUND OF THE INVENTION

There are many materials which require heat and pressure as part of their processing in producing certain characteristics. It is common, for example, to place synthetic resin pellets, particles and the like, in a dispersion medium along with various additives in a closed vessel such as an autoclave and to treat the particles by subjecting them to selected heat and pressure conditions in order to expand the plastic pellets into a usable product for molding. While such batch processing has been effective when accomplished with small quantities, the procedure becomes impractical both in terms of space required and cost in large scale commercial production. Batch processing is limited to the contents of the vessel and the limited number of processing cycles or batches which can be conducted in a day. A typical batch requires approximately an hour plus time for loading and unloading. The process is also plagued with problems of pellets clogging the evacuation valve. Further, pressure drop within the vessel during evacuation can result in premature expansion of the pellet within the vessel. This can cause a jam and a melted mass of the contents at worst, and an uneven size and quality of the expanded pellet at best. The pressure within the vessel typically is in excess of 600 psi and the temperature approximately 300° F. In view of the above, enlarging the vessel is not a practical solution for increasing production. Further, various federal and state regulations limit the size of pressure vessels. Stress of the metal under such heat and pressure cause metal fatigue, cracking and danger of rupture thereby further militating against that approach. Use of a larger vessel also would adversely affect heat distribution and mixing.

A continuous processing system would overcome the production quantity and vessel size problems, however, in order to provide such a system, a number of obstacles have to be overcome. The physical properties of the pellet are such that the pellets separate very quickly from the liquid slurry and cluster together. This tends to jam pipes, valves and pumps instantly. It is, therefore, necessary to keep the pellets evenly mixed in the liquid slurry at all times never allowing the particulate material to gather together and coagulate. The slurry somehow must be fed into a high pressure and high temperature chamber in which the particles are being continuously treated, i.e., in this particular Example 600 psi and 300 degrees F. Once in the treating chamber the slurry must be stirred continuously throughout its passage in the chamber and the temperature of the particulate material maintained at a consistent level. Still another problem relates to removing the treated material under controlled conditions without damage to the softened material and in a manner to allow the particulate material to expand.

Other materials treated in high pressure, high temperature conditions pose similar handling problems.

SUMMARY OF THE INVENTION

It is an object of the present invention to provide apparatus and method which overcome the above noted prior art limitations. Another object is the provision of a method and apparatus for treating various particulate material, such as pellets, particles and the like, to selected elevated pressure and/or temperature conditions in a commercially practical manner. Another object is the provision of such apparatus and method which is efficient, cost effective and easily controlled. Yet another object of the invention is the provision of apparatus for a continuous process for treating particulate material to elevated pressure and/or temperature conditions in which the apparatus has a long, useful life.

Briefly, in accordance with the invention, an elongated treatment chamber has a slurry supply network and an outlet network coupled to opposite ends thereof. The slurry supply network comprising a main circulation loop including a slurry reservoir having a slurry circulation conduit connected to a loading chamber through a first, normally open valve and a slurry return conduit from the loading chamber leading back to the reservoir through a second, normally open valve. A by-pass conduit connected between the slurry circulation conduit and the slurry return conduit through a third, normally closed valve forms a by-pass circulation loop. A slurry loading conduit connects the loading chamber to the input of the treatment chamber through a fourth, normally closed input valve. A pressure dispersion medium, e.g., water, source is connected to the treatment chamber and to the loading chamber through a fifth, normally open valve and a sixth, normally closed valve respectively. The loading chamber is also connected to to a drain through a seventh, normally closed valve.

The outlet network includes an unloading chamber connected to the outlet of the treatment chamber through an eighth, normally closed valve and to the atmosphere through a ninth, normally closed valve. A high pressure gas line, e.g., air, is also connected to the unloading chamber through a tenth, normally closed valve. If desired, an auxiliary heating source may be provided placed in heat conductive relation with the unloading chamber.

At the commencement of an operational cycle, at the first step, slurry is circulated in the main loop through the loading chamber and the treatment chamber is pressurized with high pressure water. The third, by-pass valve is opened at the second step allowing parallel circulation through the by-pass loop in addition to the main loop circulation. At the third step the second valve is closed blocking slurry from flowing from the loading chamber to the reservoir. At the fourth step the first valve is closed with the slurry being circulated only in the by-pass loop. At a fifth step the sixth valve is opened pressurizing the loading chamber. At a sixth step the fourth inlet valve to the treatment chamber is opened. At a seventh step the fifth valve is closed turning off the high pressure water directly to the treatment chamber. At an eighth step the fifth valve is opened allowing high pressure water into the treatment chamber as well as the leading chamber. In the ninth step the fourth inlet valve is closed cutting off the loading chamber from the treatment chamber. In the tenth step the sixth valve which pressurizes the loading chamber is closed. In the eleventh step the seventh, drain valve and the second valve are opened to discharge pressure in the loading chamber. In the twelfth step the first valve is opened allowing slurry to circulate through both loops and in the thirteenth step the third valve is closed stopping circulation in the by-pass loop thereby completing a full cycle. In a typical system made in accordance with the invention one cycle takes less than one quarter of a minute to complete.

With a selected pressure provided in the unloading chamber through the tenth valve, the eighth and ninth valves being closed, the eighth valve is opened to allow the treated material to enter the unloading chamber. The eighth valve is then closed and, if desired, additional pressure can be applied through the tenth valve. Further, additional heat may be applied through a suitable source. Finally, the ninth valve is opened allowing the material to egress from the unloading chamber.

The treatment chamber is an elongated tubular chamber provided with a centrally disposed, longitudinally extending rotatable shaft mounting a plurality of paddle blades spaced along the length of the shaft to maintain the solid matter evenly dispersed in the water medium. A suitable heating source such as heated oil or electrically energized heating elements is disposed about the outer periphery of the treatment chamber essentially along its entire length.

Additional objects and features of the invention will be set forth in part in the description which follows and in part will be obvious from the description. The objects and advantages of the invention may be realized and attained by means of the instrumentalities, combinations and methods particularly pointed out in the appended claims.

BRIEF DESCRIPTION OF THE DRAWINGS

The accompanying sole FIGURE of the drawing, which is incorporated in and constitutes a part of the specification, illustrates a preferred embodiment of the invention and, together with the description, serves to explain the objects, advantages and principles of the invention.

DETAILED DESCRIPTION OF THE PREFERRED EMBODIMENTS

A high pressure, elevated temperature treatment system made in accordance with the invention is indicated generally by the numeral 10 and includes a treatment chamber 12, a slurry supply network 14 and an outlet network 16. Slurry supply network 14 comprises a suitable container such as tank 18 for defining a reservoir 20 of slurry. Suitable stirring means such as propeller 18*a* driven by a motor 18*b* is provided to constantly stir the slurry in reservoir 20 to prevent migration of solid materials contained in the slurry. A slurry circulation conduit 22 is connected to a loading chamber 24 through a first, normally open valve V1. Slurry circulation conduit 22 receives slurry from reservoir 20 by means of a suitable low pressure, high volume pump such as a sump pump 28 through connecting flexible hose 22*a*. A slurry return conduit 30 is connected between loading chamber 24 and tank 18 through a second, normally open valve V2. Loading chamber 24 is connected to the inlet end 12*a* of the treatment chamber by means of conduit 34 through a fourth, normally closed input valve V4. A high pressure fluid source, such as high pressure water denoted by arrow 36, is connected to inlet end 12*a* of treatment chamber 12 by conduit 38 through a fifth, normally open valve V5 and to loading chamber 24 through a sixth, normally closed valve V6. Loading chamber 24 is also connected to a suitable drain through a seventh, normally closed valve V7.

Outlet network 16 comprises an unloading chamber 40 connected to outlet end 12*b* of treatment chamber 12 through an eighth, normally closed valve V8 and to ambient or atmosphere through a ninth, normally closed valve V9. A suitable high pressure gas source, such as high pressure air, denoted by arrow 42, is connected to unloading chamber 40 through a tenth, normally closed valve V10. Auxiliary heat source 40*a*, such as an electrical resistance tape may be placed in heat conductive relation with the treated material as by wrapping tape 40*a* around chamber 40 in order to trim the temperature of the material to any selected level, including levels higher than in the treatment chamber.

As will be described in greater detail below, valves V1–V10, which preferably are electrically energizable, are caused to operate in a selected sequence to move a slurry through a treatment chamber of high pressure and high temperature by means of a suitable programmable controller 44 which is electrically connected to the valves through lines L1–L10 as shown in the drawing.

Treatment chamber 12 is an elongated tubular member, for example a pipe of suitable heat conductive material such as steel 30 to 40 feet in length, having a suitable heating means 46 circumscribing the chamber and extending generally along its entire length. Heating means 46 can comprise heated oil circulated through jacket 46*a,* electrical resistance heating units or the like. Preferably, mixing means 48 is provided in treatment chamber 12 to constantly stir up the slurry. Mixing means 48 is shown to comprise a plurality of spaced paddle blades 48*a* mounted on a rotatable shaft 46*b* driven by a suitable motor 48*c*. A main bearing assembly 48*d* disposed in housing 48*e,* located where shaft 48*b* enters chamber 12 is preferably pressurized with circulating cool water denoted by arrow 48*f* to maintain the bearing assembly 48*d* cool and prevent contamination from entering housing 48*e* and thereby damaging the bearing assembly. The pressure level of the cooling water 48*f* is maintained at a level preferably slightly higher than the pressure in treatment chamber 12. Other simple bearings are located at intervals along the length of shaft 48*b* as required (not shown).

Slurry is moved into the high pressure, high temperature treatment chamber 12 by utilizing the main and by-pass loops along with a selected sequence of valve operation. Initially, slurry is circulated through loading chamber 24 in the main loop. Loading chamber 24 is then closed off from circulation and pressurized. Inlet valve V4 leading to the high pressure, high temperature treating chamber 12 then can be easily opened due to the equalization of pressure on either side of the valve. Depending on the specific gravity of the particulate material relative to the liquid medium, the particulate material can be floated, dropped or pushed into the treating chamber 12 using a slight differential in pressure. Movement of slurry into treating chamber 12 is augmented and completed by means of high pressure water directed through the loading chamber 24. After the slurry has been moved from the loading chamber 24, inlet valve V4 can be easily closed, again due to equalization of pressure on either side of the valve. Then, after loading chamber 12 has been depressurized, the continually circulating slurry in the slurry supply network can be directed through the loading chamber in preparation of the next cycle.

Treated slurry is removed from chamber 12 using a reverse procedure. Unloading chamber 40 may be pressurized to a selected level, preferably somewhat lower than the pressure level in the treatment chamber through valve V10, and then valve V8 is opened allowing the treated slurry to move into unloading chamber 40. Again, depending on the specific gravity of the particulate material, movement of the material can be effected by floating, dropping or pushing as described above in connection with loading the slurry into the treating chamber. Opening and closing of valve V8 is easily effected due to minimal or no pressure differential across the valve.

More specifically, system 10 has been effectively operated using a sequence of valve operation for the slurry supply network with plastic pellets disposed in a water medium along with various selected additives shown in Table 1. It will be understood that the specific times can be varied as needed. In the illustrated example the specific gravity of the particulate material is less than that of the liquid medium used to form the slurry.

TABLE 1

| TIME (SEC) | STEP | V1 | V2 | V3 | V4 | V5 | V6 | V7 |
|---|---|---|---|---|---|---|---|---|
| 00.0 | 1 | 0 | 0 | C | C | 0 | C | C |
| 01.0 | 2 | 0 | 0 | 0 | C | 0 | C | C |
| 02.0 | 3 | 0 | C | 0 | C | 0 | C | C |
| 02.5 | 4 | C | C | 0 | C | 0 | C | C |
| 03.0 | 5 | C | C | 0 | C | 0 | 0 | C |
| 05.0 | 6 | C | C | 0 | 0 | 0 | 0 | C |
| 05.5 | 7 | C | C | 0 | 0 | C | 0 | C |
| 09.0 | 8 | C | C | 0 | 0 | 0 | 0 | C |
| 09.5 | 9 | C | C | 0 | C | 0 | 0 | C |
| 10.5 | 10 | C | C | 0 | C | 0 | C | C |
| 12.0 | 11 | C | 0 | 0 | C | 0 | C | 0 |
| 13.0 | 12 | 0 | 0 | 0 | C | 0 | C | C |
| 14.0 | 13 | 0 | 0 | C | C | 0 | C | C |

With regard to Table 1, at step 1 slurry is circulated through the main loop, including loading chamber 24, and treatment chamber 12 is pressurized. At step 2 slurry is also circulated in the by-pass loop while in step 3 circulation is limited to the by-pass loop. At step 4 the particulate material is allowed to float upwardly in loading chamber 24. At step 5 the loading chamber is pressurized. At step 6 inlet valve V4 is opened. At step 7 the high pressure water leading directly to the treatment chamber is cut off with the high pressure water through the loading chamber pushing the slurry into the treating chamber. At step 8 high pressure water is again placed in communication with the treating chamber 12. At step 9 loading chamber 24 is cut off from treating chamber 12. At step 10 high pressure water is cut off from the loading chamber. At step 11 drain valve V7 and the return line is opened discharging pressure from the loading chamber. At step 12 valve V1 is opened to allow circulation through both loops and at step 13 valve V3 is closed to limit circulation to the main loop. The system is then ready to repeat the cycle with the total time taken for one cycle approximately 14 seconds.

System 10 can be used with various types of particulate material for which it is desired to treat at elevated pressures and/or temperatures. By way of example, one such material comprises plastic pellets which are conventionally expanded using batch processing techniques. As explained above, in conventional processing the pellets are placed in a closed vessel such as an autoclave, with liquid and other additives. The mix is heated, pressurized and stirred and then evacuated to atmospheric pressure where the softened pellet expands to a usable product for molding.

By means of the invention an improved, apparatus and method are provided for a continuous process for treating such pellets for expansion overcoming the prior art limitations referenced supra. The slurry is always maintained in a state of motion and is never allowed to cluster together. The valves are operated so that slurry is circulated through the loading chamber when not loading, and through the by-pass loop during loading. This allows the slurry to be moved against virtually no head pressure since the circulation is effected using high volume, low pressure slurry pumping means. The size of the reservoir and the capacity of the slurry pump is chosen to be much greater than that required to load the treatment chamber through the loading chamber so that a high rate of circulation is obtained through the slurry tank and the main and by-pass loops as well as facilitating the maintenance of a consistent solid to liquid ratio of the slurry.

As noted above, attempting to load the slurry by pumping the slurry directly into the high pressure, high temperature treatment chamber would result in pump failure due to melting and jamming of pellets within the impellers, valves and pistons from the attendant pressure and friction. By means of the invention, loading is accomplished with a simple high pressure water pump pumping only pure water. When the slurry by-pass loop is opened and the loading chamber is closed off from circulation, valve V6 opens and high pressure water enters the bottom of the loading chamber and pressurizes the loading chamber, for example at 750 psi. The pellets, having a lower specific gravity relative to the water, float upwardly. The inlet valve V4 from the pressurized loading chamber to the treatment chamber is opened for the time needed to push and gently float up the pellets into the treatment chamber. The inlet valve to the treatment chamber is then closed and the drain valve is opened to drain the high pressure water which can then be filtered and reused (not shown). The circulation of slurry is then immediately shifted from the by-pass loop to the main loop through the loading chamber in preparation for the next loading cycle.

As noted above, the treatment chamber comprises an elongated, high pressure pipe. The diameter of the pipe need not be large as the required volume can be determined by the length of the pipe and speed of the slurry passage through the pipe. The pipe is jacketed generally along its entire length with a heating source. Since the diameter of the pipe is relatively small compared to batch process type tanks the slurry is always in optimum heat transfer relation to the heat source. Full heat is always available along the length of the chamber for the entire time the slurry is in the chamber with no comparable heat-up time required in batch type procedures. The rotatable shaft provided with paddle blades maintain the slurry constantly in motion resulting in even heat distribution and separation of the particulate material.

The pressurized cool water circulated through housing **48*e* keeps bearing 48*d*** cool and prevents contamination from entering and damaging the bearing or associated seals.

Removing the processed pellets from a continuously processing treatment chamber presents certain problems. Outlet valves wear and are jammed and damaged by high pressure and heat. The size of the orifice in such valves need to be limited to prevent excessive pressure drop in the treatment chamber causing the pellets to prematurely expand and jam the outlet valve. The unloading chamber made in accordance with the invention, however, obviates these problems. The orifices of the valves leading to and from the unloading chamber are very large preventing any damage or jamming to the pellets. Since both valves are never opened at the same time, essentially no pressure drop results from the large orifices. The valves never close against a high pressure differential but always have essentially the same pressure on both sides when closing thereby adding to their longevity.

As the pressure in the unloading chamber builds, the treatment chamber outlet valve V8 opens allowing processed pellets to move into the unloading chamber at a controlled speed dependent on the pressure in the unloading chamber. Valve V8 is then closed. Additional high pressure air may then be introduced into the unloading chamber via valve V10 to a pressure higher than the treatment chamber pressure to further pressurize the pellets. Additional heat may be added to further prepare the pellets for maximum expansion. The level to which the pressure and/or temperature is increased will determine the size of the expanded pellet. The outer outlet valve V9 with a full size orifice, is then opened and the high pressure air expels the pellets high into the air, directed by the orientation of the unloading chamber 40 which is slanted upwardly, to float down and cool without damage to their shape and landing in a suspended net tank (not shown) or the like. The remaining liquid slurry and additives can be filtered and recycled.

Although the invention has been described with regard to specific preferred embodiments thereof, variations and modifications will become apparent to those skilled in the art. For example, it is within the purview of the invention to provide additional slurry supply networks connected to inlets (not shown) of the treatment chamber disposed at selected locations intermediate to the inlet and outlet ends for treating and adding other types of pellets requiring shorter treatment times. Such networks would comprise separate slurry containers, valves and associated components. It is therefore the intention that the appended claims be interpreted as broadly as possible in view of the prior art to include all such variations and modifications.

What is claimed:

1. A method for intermittently feeding slurry into a high pressure, high temperature treatment chamber having an inlet end and an outlet end used to treat particulate material in the slurry in a continuous process in which a reservoir of slurry is maintained in a slurry container comprising the steps of forming a main slurry circulation loop having a slurry circulation conduit connected between the slurry container and a loading chamber through a first valve and a slurry return conduit connected between the loading chamber and the slurry container through a second valve, forming a by-pass circulation loop by connecting a by-pass conduit between the slurry circulation conduit and the slurry return conduit through a third valve, continuously pumping slurry from the reservoir through at least one of the main and by-pass circulation loops, connecting the loading chamber to the treatment chamber through a slurry inlet valve, providing a high pressure liquid source and connecting the high pressure liquid source to the treatment chamber and to the loading chamber through respective fifth and sixth valves, connecting the loading chamber to a drain through a seventh valve and performing operational cycles by sequentially opening and closing the valves a plurality of times per minute during the treatment of such particulate material.

* * * * *